US005466553A

United States Patent [19]

Okutani et al.

[11] Patent Number: 5,466,553

[45] Date of Patent: Nov. 14, 1995

[54] TONER FOR DEVELOPING ELECTROSTATIC IMAGE

[75] Inventors: Haruo Okutani; Toshio Tagami; Hideki Kurebayashi; Kazue Nakadera, all of Shizuoka, Japan

[73] Assignee: Tomoegawa Paper Co., Ltd., Tokyo, Japan

[21] Appl. No.: 216,270

[22] Filed: Mar. 23, 1994

[30] Foreign Application Priority Data

Mar. 25, 1993 [JP] Japan ..... 5-090747
Jun. 28, 1993 [JP] Japan ..... 5-178595

[51] Int. Cl.[6] ..... G03G 9/087
[52] U.S. Cl. ..... 430/109
[58] Field of Search ..... 430/109

[56] References Cited

U.S. PATENT DOCUMENTS 4,052,325 10/1977 Santilli ..... 430/114
4,416,965 11/1983 Sandhu et al. ..... 430/109
5,294,682 3/1994 Fukuda et al. ..... 430/109 X

FOREIGN PATENT DOCUMENTS 82 1/1990 Japan ..... 430/109

*Primary Examiner*—Roland Martin
*Attorney, Agent, or Firm*—Wenderoth, Lind & Ponack

[57] ABSTRACT

A toner for developing an electrostatic image, which is composed of a binder resin and a colorant as main components, said binder resin containing a phenolic hydroxyl group-containing polyester resin as a main component, which toner is energy-saving, suitable for use in a contact heat fixing method using a hot roller, has a high fixing strength at a low temperature and excellent offset preventing properties and is excellent in fixing strength and offset preventing properties in a broad fixing temperature range.

4 Claims, No Drawings

TONER FOR DEVELOPING ELECTROSTATIC IMAGE

FIELD OF THE INVENTION

The present invention relates to a toner for developing an electrostatic image, which is for use in electrophotography, an electrostatic recording process, an electrostatic printing process, and the like.

PRIOR ART OF THE INVENTION

In the electrophotography, electrostatic recording process and electrostatic printing process, an electrostatic image formed on an electrostatic image support is visualized by toner particles prepared by dispersing a colorant in a resin. The so-visualized image is directly fixed on the electrostatic image support, or it is transferred to other support and fixed. Therefore, the toner is required to have not only excellent development properties but also excellent fixing strength. In recent years, particularly, the accomplishment of low-energy fixing is strongly required in view of energy saving.

A heat fixing method includes a non-contact heat fixing method using an oven and a contact heat fixing method using a hot roller. The contact heat fixing method meets the demands of the times in view of energy saving, since it achieves high heat efficiency, requires no much electric power in a fixing portion and permits the downsizing of the fixing portion. However, the problem with this method is that an "offset" occurs. The "offset" refers to the following phenomenon; Part of a toner forming an image adheres to a hot roller surface, and tile transferred toner is then transferred to a support on which an image to be fixed is formed, whereby the image is stained. For preventing this offset phenomenon, a variety of proposals have been made and some of them have been put to practical use.

For example, it is a widely employed practice to incorporate a compound having releasability such as a wax into a toner. However, this proposal has not succeeded in a low-energy fixing. It has been also proposed to use a polymer having a high molecular weight as a resin which is to compose a toner. The toner containing a polymer having a high molecular weight can prevent tile offset, while it has a high softening point so that the fixing temperature is high. It is hence difficult to perform tile low-energy fixing. Further, impractically, the resin becomes tough so that it is difficult to pulverize the resin at the time of producing a toner. For overcoming these problems, it has been proposed to use a vinyl polymer, such as polystyrene, as a polymer having a broad molecular weight distribution, from a low molecular weight to a high molecular weight. This toner satisfies the offset prevention and the fixing strength to some extent, while the fixing strength at a low temperature is not satisfactory. On the other hand, a resin produced by condensation such as a polyester resin gives a polymer having a relatively low molecular weight. It has been therefore proposed to use such a resin to produce a toner which permits the low-temperature fixing.

JP-A-54-114245, JP-A-58-11955 and JP-A-58-14147 disclose toners containing mixtures of vinyl polymers having high molecular weights and polyester resins having low molecular weights, which toners utilize the characteristics of the above vinyl polymers and polycondensation resins. Since, however, no uniform mixture of the resins can be prepared, it is difficult to produce a toner which can be uniformly frictionally charged.

JP-B-45-12580, JP-B-52-22996, JP-A-54-86342, JP-A-55-38524 and JP-A-55-40407 disclose toners containing polyester resins. Further, JP-A-54-85342, JP-A-56-1952, JP-A-56-21136, JP-A-56-168660, JP-A-57-37353, JP-A-58-14146, JP-A-59-30542, JP-A-61-105561, JP-A-61-105563, JP-A-61-124961 and JP-A-61-275769 disclose toners containing crosslinked resins produced from monomers part of which contains an alcohol having at least three hydroxyl groups and/or a carboxylic acid having at least three hydroxy groups for preventing the offset.

In the toners containing the above resins, however, when the amount of the polyhydric alcohol or polyhydric carboxylic acid is 30 mol % or less, the crosslinking reaction does not proceed sufficiently so that the effect on the offset prevention is insufficient. Further, when the above amount exceeds 30 mol %, the effect on the offset prevention can be obtained, while unreacted alcoholic hydroxyl group or carbonyl group from the carboxylic acid is liable to remain, and the resistance of the toner to humidity greatly decreases.

SUMMARY OF THE INVENTION

It is an object of the present invention to provide an energy-saving toner for developing an electrostatic image, which is suitable for use in a contact heat fixing method using a hot roller.

It is another object of the present invention to provide a toner for developing an electrostatic image, which has a high fixing strength at a low temperature and excellent offset preventing properties.

It is further another object of the present invention to provide a toner for developing an electrostatic image, which is excellent in fixing strength and offset preventing properties in a broad fixing temperature range.

The above objects and advantages of the present invention are achieved by a toner for developing an electrostatic image, which is composed of a binder resin and a colorant as main components, said binder resin containing a phenolic hydroxyl group-containing polyester resin as a main component.

DETAILED DESCRIPTION OF THE INVENTION

The binder resin used in the present invention contains, as a main component, a polyester resin containing a phenolic hydroxyl group. The above polyester resin containing a phenolic hydroxyl group is a resin produced by the polycondensation of a diol component (A), a dicarboxylic acid or a lower alkyl ester thereof (B), and a phenolic hydroxyl group-containing carboxylic acid or a lower alkyl ester thereof (C).

In the present invention, the "lower alkyl" refers to an alkyl group having 1 to 6 carbon atoms.

The above diol component (A) includes diethanolamine, ethylene glycol, diethylene glycol, propylene glycol, isoprene glycol, octanediol, 2,2-diethyl-1,3-propanediol, spiroglycol, neopentyl glycol, 1,3-butanediol, 1,4-butanediol, 2-butyl-2-ethyl-1,3-propanediol, 1,6-hexanediol, hexylene glycol, 1,5-pentanediol, 3-methyl-1,5-pentanediol, hydrobenzoin, bis(β-hydroxyethyl)terephthalate, bis(hydroxybutyl)terephthalate, polyoxyethylene-substituted bisphenol A, polyoxypropylene-substituted bisphenol A, polyoxyethylene-substituted biphenol and polyoxypropylene-substituted biphenol.

The above dicarboxylic acid or lower alkyl ester thereof (B) includes fumaric acid, maleic acid, succinic acid, itaconic acid, mesaconic acid, citraconic acid, glutsconic acid, phthalic acid, isophthalic acid, terephthalic acid, cyclohexanedicarboxylic acid, cyclohexenedicarboxylic acid, adipic acid, sebacic acid, dodecanoic diacid, naphthalenedicarboxylic acid, biphenyl-4,4'-dicarboxylic acid, 2,3-piperazine.dicarboxylic acid, iminodicarboxylic acid, imidazole-4,5-dicarboxylic acid, piperidine.dicarboxylic acid, pyrazoledicarboxylic acid, N-methylpyrazoledicarboxylic acid, N-phenylpyrazoledicarboxylic acid, pyridinedicarboxylic acid, carbazole-3,6-dicarboxylic acid, 9-methylcarbazole-3,6-dicarboxylic acid, carbazole-3,6-dibutyric acid, carbazole-3,6-γ, γ'-diketobutyric acid and lower alkyl esters of these.

The above phenolic hydroxyl group-containing carboxylic acid or lower alkyl ester thereof (C) includes a monocarboxylic acid, a dicarboxylic acid, tricarboxylic acid and lower alkyl esters of these.

The above phenolic hydroxyl group-containing monocarboxylic acid includes o-hydroxybenzoic acid, m-hydroxybenzoic acid, p-hydroxybenzoic acid, 2,4-dihydroxybenzoic acid, o-hydroxyphenylacetic acid, m-hydroxyphenylacetic acid, p-hydroxyphenylacetic acid, o-hydroxycinnamic acid, m-hydroxycinnamic acid, p-hydoxycinnamic acid, 3,4-dihydroxycinnamic acid, protocatechuic acid, gallic acid, phenolphthalin, 4-hydroxyanthraquinone- 2-carboxylic acid, hydroxy-o-toluic acid, hydroxy-m-toluic acid, hydroxy-p-toluic acid, hydroxy-1-naphthoic acid and hydroxy-2-naphthoic acid.

The above phenol it hydroxyl group-containing dicarboxylic acid includes 4-hydroxyisophthalic acid, 5-hydroxyisophthalic acid, 4,6-dihydroxyisophthalic acid, 2,5-dihydroxy-1,4-benzene diacetic acid, chelidamic acid, bis(2-hydroxy-3-carboxyphenyl)methane, hydroxyterephthalic acid, 3-hydroxyphthalic acid and 4-hydroxyphthalic acid.

The above phenolic hydroxyl group-containing tricarboxylic acid includes phenol-2,4,6-tricarboxylic acid (hydroxytrimesic acid) and 5-hydroxytrimellitic acid.

Of the above phenol is hydroxyl group-containing carboxylic acids, preferred are the dicarboxylic acid and lower alkyl ester thereof, since these particularly give polyester resins which satisfy the properties required of a resin for a toner, such as heat-melting properties and milling properties.

The above phenolic hydroxyl group-containing carboxylic acids may be used alone or in combination. The amount of the above dicarboxylic acid is 1 to 100 mol %, preferably 20 to 100 mol %, more preferably 5 to 50 mol % of the total amount of the phenolic hydroxyl group-containing carboxylic acid or lower alkyl ester thereof (C).

The amount of the phenolic hydroxyl group-containing carboxylic acid or lower alkyl ester thereof (C) is 5 to 90 mol %, preferably 10 to 90 mol % based on the total amount of the dicarboxylic acid or lower alkyl ester thereof (B) and the phenolic hydroxyl group-containing carboxylic acid or lower alkyl ester thereof (C). When the above amount of the component (C) is larger than the above upper limit, the pulverization property becomes poor, and a fine powder is liable to occur. Further, the binder resin is liable to absorb water and shows poor humidity resistance. As a result, the toner is deteriorated in chargeability. When the above amount of the component (C) is less than the above lower limit, the effect to be produced by the addition is not sufficient, and it is difficult to achieve the objects of the present invention.

Further, known polycarboxylic acids and polyols may be used in combination for the synthesis of the polyester resin used in the present invention. Examples of these polycarboxylic acids include trimellitic acid, pyromellitic acid, 1,2,4-cylcohexanetricarboxylic acid, 1,2,4-naphthalenetricarboxylic acid, 2,5,7-naphthalenetricarboxylic acid, pyridinetricarboxylic acid, pyridine-2,3,4,6-tetracarboxylic acid, 1,2,7,8-tetracarboxylic acid and anhydrides of these. Examples of the above polyols include glycerin, trimethylolpropane, trimethyoloethane, triethanolamine, pentaerythritol, sorbitol, glycerol and 1,3,5-trihydroxymethylbenzene.

The phenolic hydroxyl group-containing polyester resin used in the present invention can be obtained, for example, by the following method. The diol component (A), the dicarboxylic acid or lower alkyl ester thereof (B) and the phenolic hydroxyl group-containing carboxylic acid or lower alkyl ester thereof (C) are placed in a four-necked, round-bottom flask having a stirrer, a condenser and a nitrogen gas-introducing tube such that the amount of the reactive group of the diol component and the total amount of the acid components are of reaction equivalents, and the resultant mixture is heated to 180° to 220° C. with introducing a nitrogen gas through the nitrogen gas-introducing tube. After the formation of water by an ester reaction and an alcohol by an ester exchange reaction is completed, the reaction mixture is temperature-increased up to 200° to 240° C. over 30 minutes to 1 hour, and this temperature is maintained for 2 to 6 hours to give a phenolic hydroxyl group-containing polyester resin, which is used in the present invention.

The polyester resin used in the present invention preferably has a glass transition temperature, measured with a differential scanning calorimeter (DSC), of at least 50° C., preferably 50° to 80° C., and a flow softening point, measured with a Koka type flow tester, of 80° to 150° C., preferably 80° to 120° C.

The measurement of the flow softening point with a Koka type flow rester (CFT-500C, supplied by Shimadzu Corporation) is carried out as follows. Pellets of a resin is placed in a cylinder having a preheated temperature of about 50° to 80° C. and having a cross-sectional area of about 1 $cm^2$. The cylinder has a bottom plate including an opening (or nozzle-like opening) having a diameter of 1 mm and a length of 1 mm. A plunger having a cross-sectional area (plunger head surface) of 1 $cm^2$ is set on the pellets while the plunger is under a load of 20 kgf. The pellets are heated at a temperature elevation rate of 6° C./minute to soften the pellets. As a result, the softened resin is exhausted through the opening while the plunger moves downward. The temperature at which the plunger lead has reached a point located at ½ of the height (distance) from the point where the plunger starts to move down to the bottom of the cylinder is taken as a softening point.

The binder resin used in the present invention may be a blend of the above phenolic hydroxyl group-containing polyester resin and an epoxy compound. The amount of the epoxy resin based on the sum total of unreacted carboxyl group and phenol is hydroxyl group is 1 to 100 mol %. The above epoxy compound is a compound having at least one epoxy group per molecule. The epoxy compound includes phenyl glycidyl ether, a bisphenol A type epoxy resin, a phenol novolak type epoxy resin, diglycidyl adipate, ethylene glycol diglycidyl ether, hydroquinone diglycidyl ether, glycerin triglycidyl, tetraglycidoxytetraphenylethane, diglycidyl phthalate, pentaerythritol tetraglycidyl ether and dicylcopentadiene oxide. The epoxy compound reacts with the above polyester resin to form a reaction product.

The toner for developing an electrostatic image, provided by the present invention, is produced by dispersing and mixing a colorant, a charge controlling agent, an optional magnetic powder and optional other binder resin in/with the above binder resin and milling the dispersion or mixture.

The colorant includes carbon black, aniline blue, phthalocyanine blue, quinoline yellow, Malachite Green, lamp black, Rhodamine B and quinacridone. The colorant is used in an amount of 1 to 20% by weight based on the resin.

The charge controlling agent includes Nigrosine dye, ammonium salt, pyridinium salt and azine for a positively chargeable toner. The charge controlling agent is used in an amount of 0.1 to 10% by weight based on the resin.

A toner containing a polyester resin generally negatively chargeable. However, when a charge controlling agent for a negatively chargeable toner is added as required, a chromium complex and an iron complex are used. When the toner has negative polarity to excess, the above positively chargeable charge controlling agent may be added for neutralizing the polarity.

According to the present invention, there is provided a toner for developing an electrostatic image, which is free from the occurrence of the offset and has a high fixing strength at a low temperature and which is also excellent in grindability. Further, according to the present invention, there is provided a toner for developing an electrostatic image, which is free from the occurrence of the offset in a broad fixing temperature range and excellent in fixing strength, and which is also excellent in grindability.

The present invention will be further explained hereinafter with reference to Examples.

Synthesis Example 1

A four-necked round-bottom flask having a stirrer, a condenser and a nitrogen gas-introducing tube was charged with 316 g (1 mol) of 2,2'-bis [4-(2-hydroxyethyl] propane, 97 g (0.5 mol) of dimethyl isophthalate, 105 g (0.5 mol) of dimethyl 5-hydroxyisophthalate, 2.5 g of zinc acetate and 2.5 g of titanium tetraisopropoxide, and while a nitrogen gas was introduced through the nitrogen gas-introducing tube, the above components were heated to 200° C. After the outflow of methyl alcohol finished, the reaction mixture was temperature-increased up to 230° C. over 1 hour, and further allowed to react for 4 hours to give a resin. The resin had a glass transition temperature, measured with DSC, of 63° C. and a flow softening point, measured with a Koka type flow tester, of 105° C. For the measurement of flow softening points in Examples including this Synthesis Example 1, a Kokatype flow tester (model CFT-500C, supplied by Shimadzn Corporation) was used.

Synthesis Example 2

221.2 Grams (0.7 mol) of 2,2'-bis[4-(2-hydroxyethyleneoxy)phenyl] propane, 82.2 g (0.3 mol) of 4,4'-bis(2-hydroxyethyleneoxy)phenyl, 155.2 g (0.8 mol) of dimethyl isophthalate and 42 g (0.2 mol) of dimethyl 5-hydroxyisophthalate were allowed to react in the same manner as in Synthesis Example 1 to give a resin. The resin had a glass transition temperature, measured with DSC, of 60.5° C. and a flow softening point, measured with a Koka type flow tester, of 97.5° C.

Synthesis Example 3

189.6 Grams (0.6 mol) of 2,2'-bis[4-(2-hydroxyethyleneoxy)phenyl] propane, 109.6 g (0.4 mol) of 4,4'-bis(2-hydroxyethyleneoxy)phenyl, 210 g (1 mol) of dimethyl 5-hydroxyisophthalate were allowed to react in the same manner as in Synthesis Example 1 to give a resin. The resin had a glass transition temperature, measured with DSC, of 83° C. and a flow softening point, measured with a Koka type flow tester, of 93° C.

Synthesis Example 4

A resin was synthesized in the same manner as in Synthesis Example 2 except that dimethyl hydroxyisophthalate was replaced with 57.5 g (0.2 mol) of bis(2-hydroxy-3-carboxyphenyl)methane. The resin had a glass transition temperature, measured with DSC, of 60° C. and a flow softening point, measured with a Koka type flow tester, of 100° C.

Synthesis Example 5

189.6 Grams (0.5 mol) of 2,2'-bis[4-(2-hydroxyethyleneoxy)phenyl] propane, 109.6 g (0.4 mol) of 4,4'-bis(2-hydroxyethyleneoxy)phenyl, 155.2 g (0.8 mol) of dimethyl isophthalate and 42 g (0.2 mol) of dimethyl 5-hydroxyisophthalate were allowed to react in the same manner as in Synthesis Example 1 to give a resin. The resin had a glass transition temperature, measured with DSC, of 73° C. and a flow softening point, measured with a Koka type flow tester, of 112° C.

Synthesis Example 6

100 Parts by weight of the resin obtained in Synthesis Example 1 was mixed with 1.4 parts by weight of an o-cresol novolak type epoxy compound (YDCN-701, supplied by Tohto Kasei Co., Ltd.). The above amount (1.4 parts) corresponds to 5 mol % of the sum total of unreacted carboxyl group and phenolic hydroxyl group in the resin obtained in Synthesis Example 2. The resultant mixture was melt-kneaded with a twin-screw kneader at 180° C. for 1 hour to produce a reaction product. The so-obtained resin had a glass transition temperature, measured with DSC, of 64° C. and a flow softening point, measured with a Koka type flow tester, of 111° C.

The above "sum total of unreacted carboxyl group and phenolic hydroxyl group" was measured according to the Frits-Keen titration method described in "Organic Compounds Identifying Methods I", FUNAKUBO Eiichi, issued by Yokendo (1982).

Synthesis Example 7

100 Parts by weight of the resin obtained in Synthesis Example 1 was mixed with 1.3 parts by weight of a bisphenol A type epoxy compound (E-850, supplied by Dainippon Ink & Chemicals, Inc.). The above amount (1.3 parts) corresponds to 5 mol % of the sum total of unreacted carboxyl group and phenolic hydroxyl group in the resin obtained in Synthesis Example 1. The resultant mixture was melt-kneaded with a twin-screw kneader at 180° C. for 1 hour to produce a reaction product. The so-obtained resin had a glass transition temperature, measured with DSC, of 64° C. and a flow softening point, measured with a Koka type flow tester, of 116° C.

Comparative Synthesis Example

A resin was synthesized in the same manner as in Synthesis Example 1 except that no dimethyl 5-hydroxyisophthalate was used. The so-obtained resin had a glass transition temperature, measured with DSC, of 63° C. and a flow softening point, measured with a Koka type flow tester, of 107° C.

Example 1

| | |
|---|---|
| Resin obtained in Synthesis Example 1 | 100 parts by weight |
| Carbon black (MA-100, supplied by Mitsubishi Kasei Corporation) | 5 parts by weight |
| Iron complex dye | 2 parts by weight |

A mixture of the above components was melt-kneaded using an extruder with twin screws at about 150° C. The melt-kneaded mixture was cooled, pulverized with a jet mill and classified to give negatively chargeable toner particles having an average particle diameter of 10 μm. Then, 0.5 part by weight of hydrophobic colloidal silica was added to 100 parts by weight of the above toner particles to obtain a toner for developing an electrostatic image.

5 Parts by weight of the above toner was mixed with 95 parts by weight of ferrite carrier to prepare a two-component developer. The two-component developer was set in a commercially available copying machine, and an image was picked up and developed. The developed toner image was fixed with a fixing apparatus having a fixing roller surface-coated with Teflon (produced by du Pont de Nemours & Co.) and a pressure roller surface-coated with silicone rubber at a fixing roller surface temperature of 115°± 5° C. at a linear velocity of 200 mm/second. As a result, the image density measured with a Macbeth reflection densitometer RD914 was 1.5 or more, the ground portion other than the fixed image was free of a scumming, and excellent images were continuously reproduced even when 100,000 copies were made. Further, when an eraser sand was rubbed against a solid image having an image density of 1.6 10 times, the residual ratio of the toner was 85%, which showed that the above toner had the satisfactory fixing strength.

Example 2

| | |
|---|---|
| Resin obtained in Synthesis Example 2 | 100 parts by weight |
| Carbon black (#40, supplied by Mitsubishi Kasei Corporation) | 5 parts by weight |
| Iron di-tert-butyl salicylate | 2 parts by weight |

A mixture of the above components was melt-kneaded in the same manner as in Example 1. Then, the melt-kneaded mixture was pulverized and classified to give negatively chargeable particles having an average particle diameter of 10 μm. The melt-kneaded mixture showed better grindability than that in Example 1. Then, a two-component developer was prepared in the same manner as in Example 1, and an image was picked up, developed and heat-fixed in the same manner as in Example 1. The toner was evaluated in the same manner as in Example 1 to show that no offset occurred and that the fixing strength thereof was satisfactory. Further, excellent images were continuously reproduced when copies were continuously made.

Example 3

| | |
|---|---|
| Resin obtained in Synthesis Example 3 | 50 parts by weight |
| Resin obtained in Comparative Synthesis Example | 50 parts by weight |
| Carbon black (#40, supplied by Mitsubishi Kasei Corporation) | 5 parts by weight |

-continued

| | |
|---|---|
| Chromium complex dye (TRH, supplied by Hodogaya Chemical Co., Ltd.) | 2 parts by weight |

A mixture of the above components was melt-kneaded in the same manner as in Example 1. Then, the melt-kneaded mixture was pulverized and classified to give negatively chargeable particles having an average particle diameter of 8 μm. The cooled melt-kneaded mixture showed grindability as excellent as that in Example 2. Then, a two-component developer was prepared in the same manner as in Example 1, and an image was picked up, developed and heat-fixed in the same manner as in Example 1. The toner was evaluated in the same manner as in example 1 to show that no offset occurred and that the fixing strength thereof was satisfactory. Further, excellent images were continuously reproduced when copies were continuously made.

Example 4

| | |
|---|---|
| Resin obtained in Synthesis Example 4 | 100 parts by weight |
| Phthalocyanine blue pigment | 7 parts by weight |
| Chromium do-tert-butylsalicylate | 2 parts by weight |

A mixture of the above components was melt-kneaded in the same manner as in Example 1. Then, the melt-kneaded mixture was pulverized and classified to give negatively chargeable particles having an average particle diameter of 10 μm. Then, a two-component developer was prepared in the same manner as in Example 1, and an image was picked tip, developed and heat-fixed in the same manner as in Example 1. The toner was evaluated in the same manner as in Example 1 to show that cyan-color free from the occurrence of an offset and well fixed were obtained.

Comparative Example 1

| | |
|---|---|
| Resin obtained in Comparative Synthesis Example | 100 parts by weight |
| Carbon black (#40, supplied by Mitsubishi Kasei Corporation) | 5 parts by weight |
| Chromium complex dye (TRH, supplied by Hodogaya Chemical Co., Ltd.) | 2 parts by weight |

Example 1 was repeated except that the mixture of components was replaced with a mixture of the above components, to give a two component developer. An image was picked up, developed and heat-fixed in the same manner as in Example 1. The toner was evaluated in the same manner as in Example 1 to show that an offset occurred.

Example 5

| | |
|---|---|
| Resin obtained in Synthesis Example 1 | 100 parts by weight |
| Carbon black (MA-100, supplied by Mitsubishi Kasei Corporation) | 5 parts by weight |
| Iron complex dye | 2 parts by weight |
| Epoxy compound (bisphenol A type epoxy resin, E-850, supplied by Dainippon Ink & Chemicals, Inc.) | 1.3 parts by weight |

A mixture of the above components was melt-kneaded using an extruder with twin screws at about 150° C. The above amount (1.3 parts) of the epoxy compound corresponds to 5 mol % of the sum total of unreacted carboxyl group and phenolic hydroxyl group of the resin from Synthesis Example 1. The melt-kneaded mixture was cooled, pulverized and classified to give toner particles having an average particle diameter of 10 μm. Then, part by weight hydrophobic colloidal silica was added to 100 parts by weight of the above toner particles to obtain a toner for developing an electrostatic image.

5 Parts by weight of the above toner was mixed with 95 parts by weight of ferrite carrier to prepare a two-component developer. The two-component developer was set in a commercially available copying machine, and an image was picked up and developed. The developed toner image was fixed with a fixing apparatus having a fixing roller surface-coated with a fluorine resin and a pressure roller surface-coated with silicone rubber at a fixing roller surface temperature of 115°±5° C. at a linear velocity of 200 mm/second. As a result, the image density measured with a Macbeth reflection densitometer RD914 was 1.5 or more, the ground portion other than the fixed image was free of a scumming, and excellent images were continuously reproduced even when 100,000 copies were made. Further, when an eraser sand was rubbed against a solid image having an image density of 1.6 10 times, the residual ratio of the tone was 85%, which showed that the above toner had the satisfactory fixing strength.

Example 6

| | |
|---|---|
| Resin obtained in Synthesis Example 5 | 100 parts by weight |
| Carbon black (#40, supplied by Mitsubishi Kasei Corporation) | 5 parts by weight |
| Iron di-tert-butyl salicylate | 2 parts by weight |
| Epoxy compound (bisphenol A type epoxy resin, E-850, supplied by Dainippon Ink & Chemicals, Inc.) | 1.0 part by weight |

A toner was obtained from a mixture of the above component in the same manner as in Example 5. The above amount (1.0 part by weight) of the epoxy compound corresponds to 5 mol % of the sum total of unreacted carboxyl group and phenolic hydroxyl group of the resin from Synthesis Example 1. The melt-kneaded mixture showed better grindability than that in Example 5. Then, a two-component developer was prepared in the same manner as in Example 5, and an image was picked up, developed and heat-fixed in the same manner as in Example 5. The toner was evaluated in the same manner as in Example 5 to show that no offset occurred and that the fixing strength thereof was satisfactory. Further, excellent images were continuously reproduced when copies were continuously made.

Example 7

| | |
|---|---|
| Resin obtained in Synthesis Example 6 | 50 parts by weight |
| Resin obtained in Comparative Synthesis Example | 50 parts by weight |
| Carbon black (#40, supplied by Mitsubishi Kasei Corporation) | 5 parts by weight |
| Chromium complex dye (TRH, supplied by Hodogaya Chemical Co., Ltd.) | 2 parts by weight |

A mixture of the above components was melt-kneaded in the same manner as in Example 5 to give a toner. The cooled melt-kneaded mixture showed milling properties as excellent as those in Example 5. Then, a two-component developer was prepared in the same manner as in Example 5, and an image was picked up, developed and heat-fixed in the same manner as in Example 5. The toner was evaluated in the same manner as in Example 5 to show that no offset occurred and that the fixing strength thereof was satisfactory. Further, excellent images were continuously reproduced when copies were continuously made.

Example 8

| | |
|---|---|
| Resin obtained in Synthesis Example 7 | 100 parts by weight |
| Phthalocyanine blue pigment | 7 parts by weight |
| Chromium do-tert-butylsalicylate | 2 parts by weight |

A mixture of the above components was melt-kneaded in the same manner as in Example 5. Then, the melt-kneaded mixture was pulverized and classified to give a toner. Then, a two-component developer was prepared in the same manner as in Example 5, and an image was picked up, developed and heat-fixed in the same manner as in Example 5. The toner was evaluated in the same manner as in Example 5 to show that cyan-color free from the occurrence of an offset and well fixed were obtained. Further, excellent images were continuously reproduced when copies were continuously made.

Comparative Example 2

Example 5 was repeated except that the epoxy compound was not used. The toner was evaluated in the same manner as in Example 5. No offset occurred when the fixing was carried out at a fixing roller surface temperature of 120° C., while the offset occurred at a fixing roller surface temperature of 170° C.

What is claimed is:

1. A toner for developing an electrostatic image, which comprises a binder resin and a colorant as main components, said binder resin containing, as a main component, a phenolic hydroxyl group-containing polyester resin obtained by polycondensing a diol component (A), a dicarboxylic acid or a lower alkyl ester thereof (B), and a phenolic hydroxyl group-containing dicarboxylic acids, tricarboxylic acids, di- and tri- carboxylic acids or a lower alkyl ester thereof (C), wherein the amount of the component (C) is 5 to 90 mol % of the total amount of the component (B) and the component (C).

2. A toner according to claim 1, wherein the binder resin is a product obtained by incorporating 1 to 100 mol %, based on a sum total of unreacted carboxyl group and phenolic hydroxyl group or the phenolic hydroxyl group-containing polyester resin, of an epoxy compound into the phenolic hydroxyl group-containing polyester resin.

3. A toner according to claim 1, where in the phenolic hydroxyl group-containing polyester resin has a glass transition temperature of 50° C. or higher.

4. A toner according to claim 1, wherein the phenolic hydroxyl group-containing polyester resin has a flow softening point of 80° to 150° C.

* * * * *